United States Patent [19]

Ward

[11] Patent Number: 4,955,657

[45] Date of Patent: Sep. 11, 1990

[54] APPARATUS FOR REMOVAL OF FOREIGN MATERIAL FROM SINK DISPOSAL UNITS

[76] Inventor: John L. Ward, 1006 Barnwell St., Columbia, S.C. 29201

[21] Appl. No.: 485,146

[22] Filed: Feb. 26, 1990

Related U.S. Application Data

[63] Continuation-in-part of Ser. No. 324,176, Mar. 16, 1989, Pat. No. 4,911,492.

[51] Int. Cl.[5] ..... B25B 7/00; F21V 33/00

[52] U.S. Cl. ..... 294/118; 294/1.1

[58] Field of Search ..... 294/118, 66.2, 1.1, 294/100; 15/104.31, 104.32; 362/109, 253; 241/301

[56] References Cited

U.S. PATENT DOCUMENTS

| | | | |
|---|---|---|---|
| 893,029 | 7/1908 | Spannagel | 240/119 |
| 1,457,198 | 5/1923 | Utley | 15/104.32 X |
| 1,676,434 | 7/1928 | Furneaux | 81/485 |
| 2,208,883 | 7/1940 | Hall | 240/6.46 |
| 2,355,086 | 8/1944 | Lang | 294/66.2 |
| 2,786,223 | 3/1957 | Ziskind | 294/100 X |
| 2,940,289 | 6/1960 | Hellwig | 294/100 X |
| 3,163,371 | 12/1964 | Hardy | 241/100.5 |
| 3,590,235 | 6/1971 | Leo | 240/6.46 |
| 3,924,115 | 12/1975 | Hampton et al. | 362/109 X |
| 4,073,533 | 2/1978 | Debrey et al. | 294/118 |
| 4,480,295 | 10/1984 | Shuster | 294/118 |
| 4,619,248 | 10/1986 | Walsh | 128/18 |

*Primary Examiner*—Russell D. Stormer

[57] ABSTRACT

A pair of concentric cylindrical members are arranged for relative sliding movement with the lower end of the inner member being formed with outwardly projecting flexible blades. The blades are adapted to displace rubber guard elements covering a sink opening when the pair of members are received in a disposal unit, or in a sink opening without a disposal unit. The flexible blades are. normally held against their outward projection when contained within the outer member, but upon sliding movement of the inner member axially relative to the outer member, will flex radially outward so as to maximumly displace the rubber guards. The resulting displacement establishes an improved unobstructed central passageway in communication with the disposal unit grinding hopper, whereby undesired foreign matter therein may be withdrawn with the use of elongated, slenderized tongs. Optionally, lights may be supported on preferably lower portions of the cylindrical members for improved grinding hopper illumination; however, such lights can be emitted due to the maximized degree of rubber guard displacement.

20 Claims, 4 Drawing Sheets

APPARATUS FOR REMOVAL OF FOREIGN MATERIAL FROM SINK DISPOSAL UNITS

REFERENCE TO RELATED APPLICATIONS

This is a continuation-in-part of U.S. application Ser. No. 07/324,176 filed Mar. 16, 1989 and now U.S. Pat. No. 4,911,942.

BACKGROUND OF THE INVENTION

The present invention relates generally to improved sink disposal unit maintenance, and more specifically to an apparatus for insertion into a sink opening and disposal unit mouth to aid in the removal of undesired foreign matter therefrom. All disclosure of U.S. application Ser. No. 07/324,176 is incorporated herein by virtue of above reference thereto.

Sink disposal units have been commonly used in kitchen sinks in homes, restaurants, and the like for elimination of small amounts of waste, generally food or garbage items. The disposal unit is typically mounted beneath the sink basin (or drain opening), and includes a hopper which receives all matter passed thereto through the sink opening. A sink flange is often disposed about the sink opening. Liquids and solid matter (preferably ground by the disposal unit) freely flow from the hopper into outlet plumbing leading away from the sink by virtue of small drainage apertures in the disposal unit hopper. Larger solid particles, however, are prevented from passing into the outlet plumbing by virtue of the relatively small dimensions of the drainage apertures. It is generally undesirable for such larger particulate matter to enter the plumbing system, as well understood by those of ordinary skill in the art.

Grinding blades are situated within the hopper for reducing the larger waste matter therein to a finer size, preferably small enough to fit through the drainage apertures without clogging the disposal unit or the plumbing. The blades are generally electrically rotated within the unit as water is flushed through the sink to carry disintegrated or ground waste particles through the drainage apertures. A flexible splash guard is usually disposed just below the sink opening at the mouth of the hopper to prevent splashing while the disposal unit operates, and to prevent the inadvertent introduction of objects into the hopper. Further exemplary discussion of the construction and operation of conventional disposal units and splash guards may be found in Hardy U.S. Pat. No. 3,163,371, the disclosure of which is incorporated herein by reference.

Even though sink disposal units are generally provided with a flexible splash guard, it is still not uncommon for an object requiring immediate removal (rather than flushing) to inadvertently enter the disposal unit. A foreign object (such as a drink can tab, cutlery, jewelry, etc.) made of metal or plastic could damage the disposal unit if the unit were to be run while the foreign matter is within the hopper. To prevent damage to the disposal unit or to the object, or to prevent damage to or clogging of the plumbing, the foreign object must be removed.

It is undesirable and highly dangerous to have to feel around by hand beneath the splash guard inside of the wet, dirty disposal unit hopper to retrieve the foreign matter. It is also difficult to get a clear view of the hopper due to the splash guard blocking direct visual access to the hopper. Resiliency of the splash guard also impedes removal of the foreign object, whether by hand or with use of a retrieval instrument or tool of some type. Furthermore, if the foreign matter were in the hopper while the unit were running, the foreign matter may be ground into numerous pieces or may become tightly lodged in the unit, thereby making removal even more difficult. Many of the difficulties would be encountered where a resilient splash guard is present, regardless of whether a disposal unit is also present.

SUMMARY OF THE INVENTION

The present invention recognizes and addresses such drawbacks and other aspects of sink foreign matter removal in general, and in particular sink disposal unit foreign matter removal. Accordingly, one object of the present invention is to provide an apparatus for conveniently and safely removing sink foreign matter, such as from a sink disposal unit.

A further object of the present invention is to provide a device for insertion into a sink opening which displaces the splash guard associated with the disposal unit and establishes an unobstructed passageway to allow improved access to and viewability of the disposal unit hopper, for facilitating the removal of foreign matter therefrom. A more specific object is the achievement of maximized splash guard displacement.

A still further object of the present invention is to provide a device such as the foregoing for insertion into a sink opening which is capable of enlarging the access opening to an extent wherein external light sources are not necessary to facilitate the removal of foreign matter therefrom.

Another object of the present invention is to provide a device for insertion into a sink opening and including specialized means for entering the hopper through an established unobstructed passageway, to grasp and remove foreign matter from the hopper of a sink disposal unit.

Those and other objects, aspects, and features of this invention are more particularly discussed and described in the remainder of the specification. Also, differing embodiments of this invention may be provided as differing combinations of presently disclosed features. One present exemplary embodiment is directed to a device to aid in removal of foreign matter from a sink garbage disposal unit of the type having an interior refuse hopper and an elastomeric guard means adjacent an opening to such hopper. Such device preferably includes insertion means having inner and outer (i.e., concentric) cylindrical members for insertion into the hopper opening, with the inner member providing access to the hopper and being provided with means at one end thereof to deflect the elastomeric guard means so as to clear a pathway to such hopper. Also, the annular inner member preferably defines an interior passageway therethrough which permits communication with the hopper.

Such a device as the foregoing may alternately further include light means, mounted thereon for illuminating the hopper, whereby improved access to and visibility of the hopper are provided so that foreign matter may readily be grasped and removed therefrom through an inner member passageway.

Another exemplary embodiment concerns an apparatus for removal of foreign matter from a sink disposal unit of the type having a hopper disposed within the disposal unit for receiving waste material and a flexible splash guard disposed adjacent an opening to such hopper. Such an apparatus may comprise a pair of cylindrical members, having a central passageway defined within the inner member of said pair. The members are adapted for insertion into the hopper opening so as to provide access to the hopper through such central passageway. The inner member preferably further includes a lower portion for extending into the hopper opening to displace the flexible splash guard in a radially outward direction while so extending. Alternate grasping means may be provided for insertion through the inner member central passageway for grasping and removing foreign matter from the hopper.

Still another exemplary construction in accordance with this invention relates to a device comprised of a cylindrical unit arranged for insertion into a hopper opening, such unit including deflecting means at one end thereof which in one position of operation provides access to the hopper by deflecting elastomeric guard means so as to clear a pathway to such hopper, and in another position of operation is inactive; and means for selectively operating the deflecting means into such positions thereof; such unit also defining an interior passageway therethrough which permits communication with such hopper whenever the elastomeric guard means are deflected, whereby improved access to and visibility of the hopper are provided so that foreign matter may readily be grasped and removed therefrom through the passageway.

Various modifications and alterations to the features, elements, and constructions disclosed herewith may occur to those of ordinary skill in the art, and are intended to come within the spirit and scope of this invention by virtue of present reference thereto. Such modifications and variations may include, but are not limited to, the substitution of functionally equivalent structures and elements for those expressly disclosed, illustrated, or suggested herewith, as well as the interchange of various features and elements (e.g., reversal of parts) presently disclosed.

BRIEF DESCRIPTION OF THE DRAWINGS

A full and enabling disclosure of the present invention, including the best mode thereof, to one of ordinary skill in the art is set forth more particularly in the remainder of this specification, including reference to the accompanying figures, in which.

Figure 1:
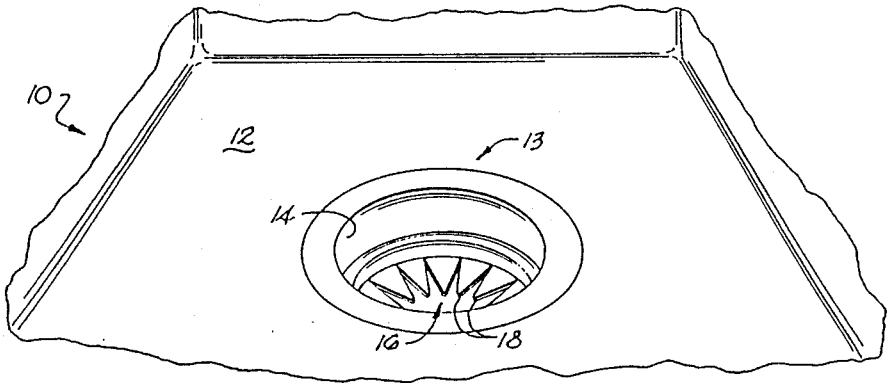
FIG. 1 illustrates a perspective view of a conventional sink showing a sink drain opening and a disposal unit splash guard mounted just beneath such opening.

Repeat use of reference characters in the following specification and appended drawings is intended to represent the same or analogous features or elements of the present invention.

DETAILED DESCRIPTION OF EXEMPLARY EMBODIMENTS

Figure 2:
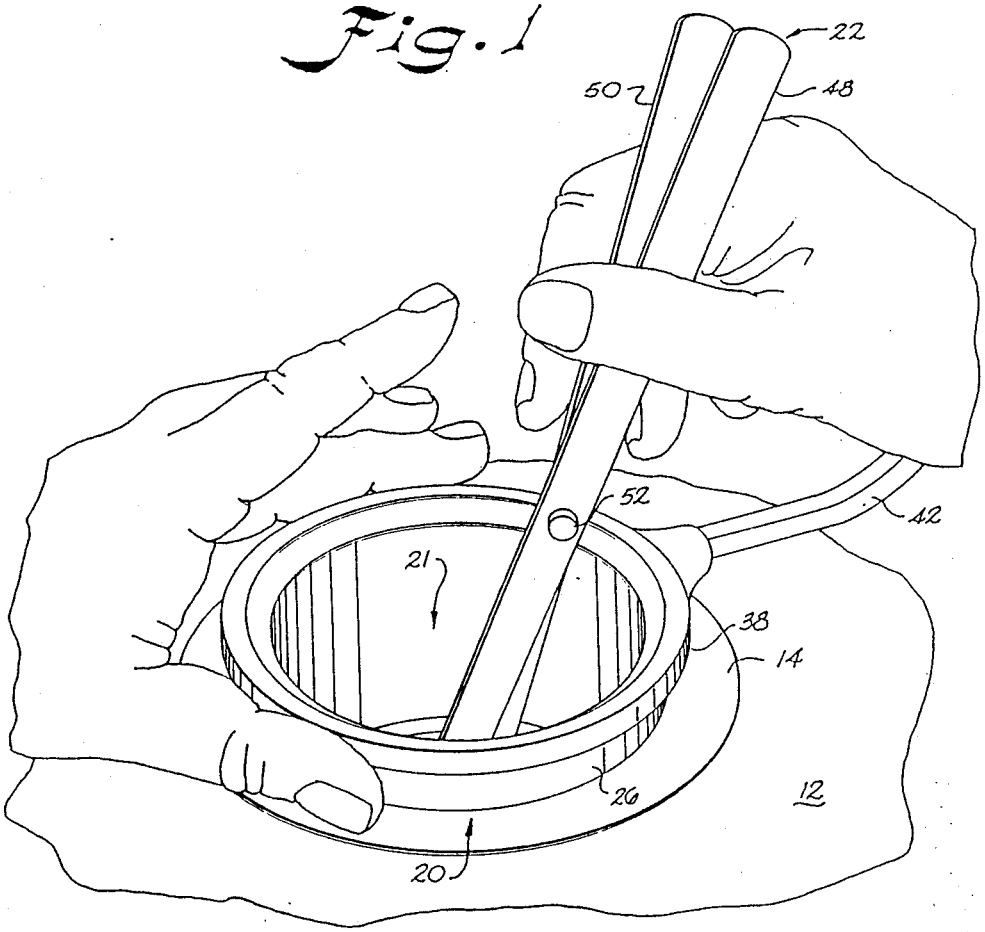
FIG. 2 illustrates a perspective view of an exemplary device in use in accordance with certain aspects of the invention, showing such device disposed within a sink opening such as of FIG. 1.
Figure 3:
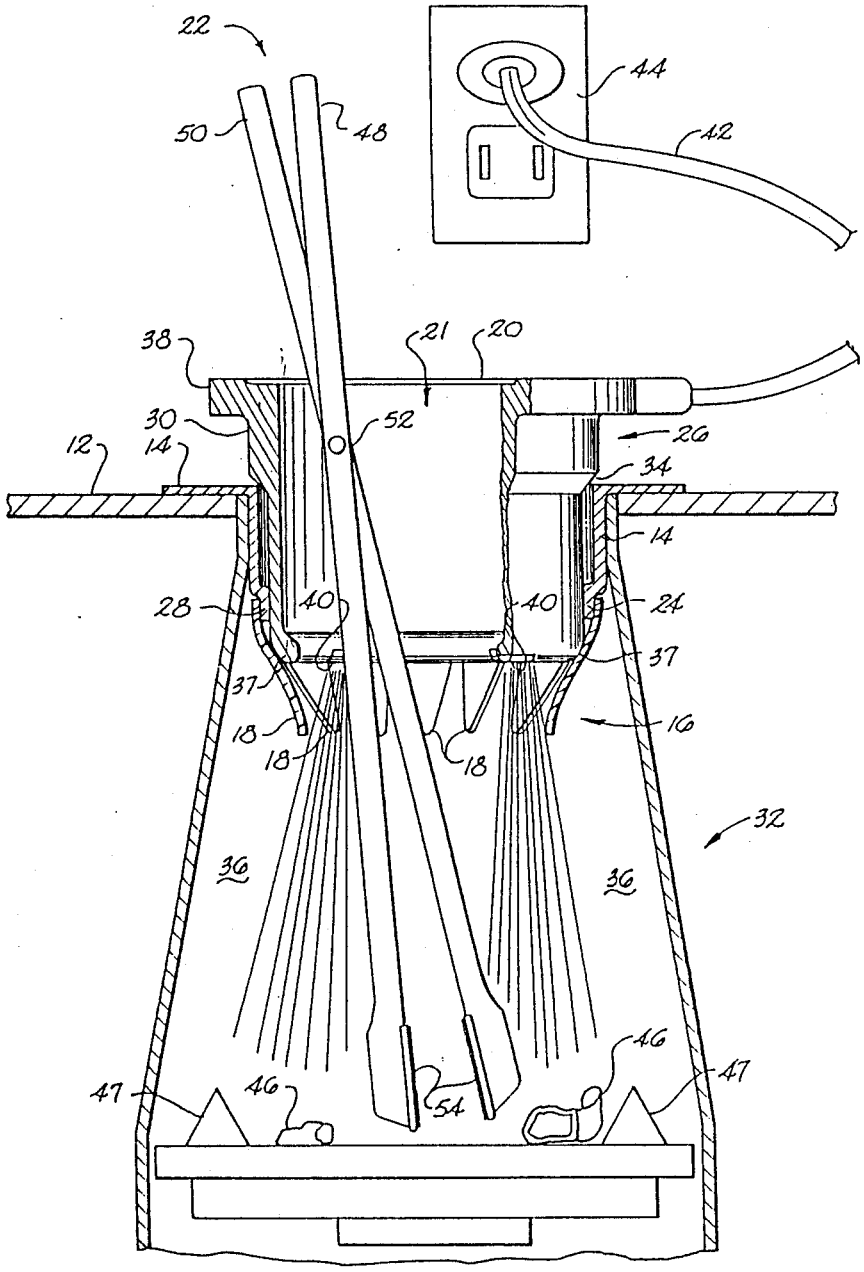
FIG. 3 illustrates a mixed side cross-sectional and partial view of an exemplary device in accordance with the embodiment of present FIG. 2, with such device received in a sink opening and disposal unit hopper, and deflecting, i.e., displacing, the flexible splash guard thereof.

Referring now to the drawings in detail, there is shown in FIG. 1 a typical sink 10 including a basin 12 and sink drain opening 13 defined by a sink flange 14. A splash guard 16 includes a plurality of resilient flexible members or leaves 18, which may be supported on either sink flange 14, or on part of a sink disposal unit. FIGS. 2 and 3 represent use of the present invention in relation to sink drain opening 13.

The present invention preferably includes a relatively thin walled annular member or annular insertion means 20 (generally rigid) for insertion into the sink opening 13. Grasping means 22 may be positioned through a central passageway 21 formed by member 20, as illustrated. Annular member 20 defines both a lower portion 24 and an upper portion 26. Lower portion 24 of annular member 20 is intended for insertion into sink opening 13 and accordingly preferably defines a lower outer diameter 28 small enough to fit inside of the diameter of sink flange 14. Outer diameter 30 of upper portion 26 is preferably greater than outer diameter 28 of lower portion 24, and is also preferably greater than the diameter of sink flange 14.

FIG. 3 shows that a resulting chamfered surface 34 is preferably disposed generally between upper portion 26 and lower portion 24. When inserted into sink opening 13, chamfered surface 34 of annular member 20 seats against sink flange 14, thereby preventing annular member 20 from completely sliding into hopper 36 of sink disposal unit 32. The relative width of angled annular chamfered surface 34 allows for the placement of annular member 20 into sink openings of various diameters (limited to a range of diameters falling between lower outer diameter 28 and upper outer diameter 30), while still being securely seated in opening 13 against sink flange 14.

In fulfillment of one of the main present objects, when annular member or annular insertion means 20 is inserted into sink flange 14, it simultaneously contacts and spreads radially outward to a certain degree the flexible members 18 of splash guard 16 from their respective positions shown in FIG. 1 to their respective positions shown in FIG. 3. Such deflection takes place as a curved, annular engagement surface 37 of lower portion 24 is urged downward against the splash guard members. It can be readily seen that greater access to hopper 36 is facilitated because annular member 20 spreads apart the splash guard members, while leaving unobstructed the central passageway 21.

An annular lip 38 of various shapes and/or sizes may be provided about upper portion 26 of annular member 20 to facilitate manipulation of the present invention during use (such as demonstrated in FIG. 2). It is desirable, but not required, that annular lip 38 be axially displaced from chamfered surface 34 for ease of such manipulation. Alternatively, if sink opening 13 is relatively large enough (that is, larger than even upper outer diameter 30), annular insertion means 20 may be seated in opening 13 against annular lip 38 thereof, rather than against its chamfered surface 34. The axial length of annular insertion means 20 may be varied as desired for proper operation with various disposal units, or in other uses of the invention.

Supported on annular member 20 (preferably on lower portion 24 thereof) is a light source or means 40, including at least one bulb (not seen due to the preferred recessed position thereof) for illuminating hopper 36. Light source 40 is operatively connected within the structure of annular member 20 by electrical wires comprising electrical supply means (not shown), including for example an electrical power cord 42 which may be plugged into a standard electrical outlet 44 or attached to any other suitable power source. Light source 40 facilitates the identification and subsequent removal of foreign matter 46 from hopper 36. One light bulb, or two spaced light bulbs (or even more) may be used. Different types of light sources, even battery or fluorescent driven or the like, may be used, and variously supported in accordance with this invention. Also, light source 40 may be relatively moved about by manipulating annular lip 38 so as to rotate annular member 20 within sink flange 14, thereby altering the illumination of desired portions of hopper 36. Such rotation or movement technique may be particularly useful if the beam pathway of light source 40 is somewhat angled.

Grasping means 22 of the present invention may assume various forms, but preferably comprises a pair of specialized tongs including two long slender bars 48 and 50 rotatably or pivotably joined by a rivet 52 or other equivalently-functioning member. As is shown in both FIGS. 2 and 3, the grasping means are placed through the central passageway 21 of annular member 20 for retrieving foreign matter 46 from hopper 36. Opposable teeth 54 disposed at a grasping end of such tongs make it easier to securely grasp and retrieve foreign matter 46 from within hopper 36, even when lodged near the bottom of hopper 36 adjacent teeth 47 of the disposal unite 32. The relatively central location of the pivot point on tongs 22 contributes to desired slenderizing of the grasping means structure.

Figure 4:
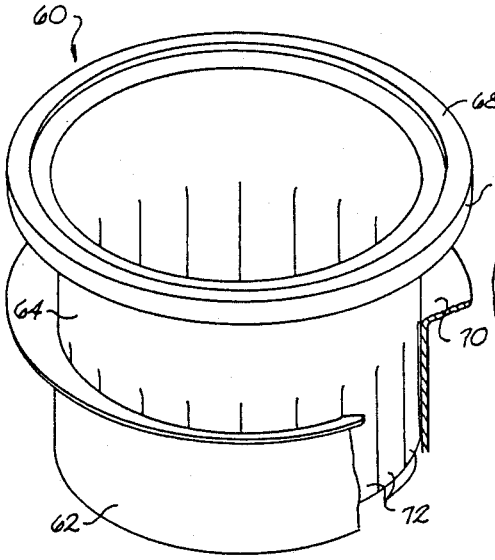
FIG. 4 illustrates a perspective view of another embodiment of an exemplary device in accordance with the present invention, showing the device with parts in one position of operation.
Figure 5:
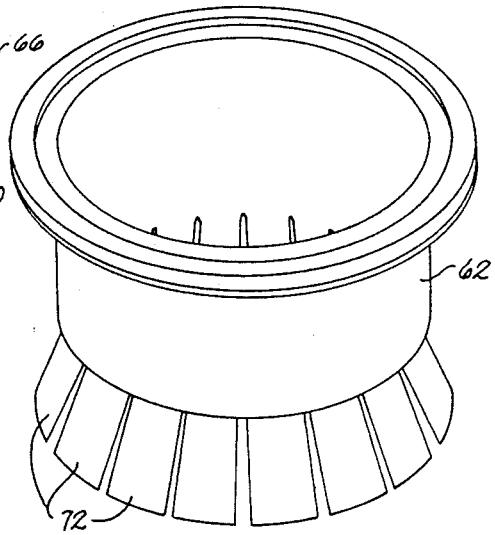
FIG. 5 illustrates a perspective view of the exemplary device of FIG. 4 with parts thereof in another position of operation.
Figure 6:
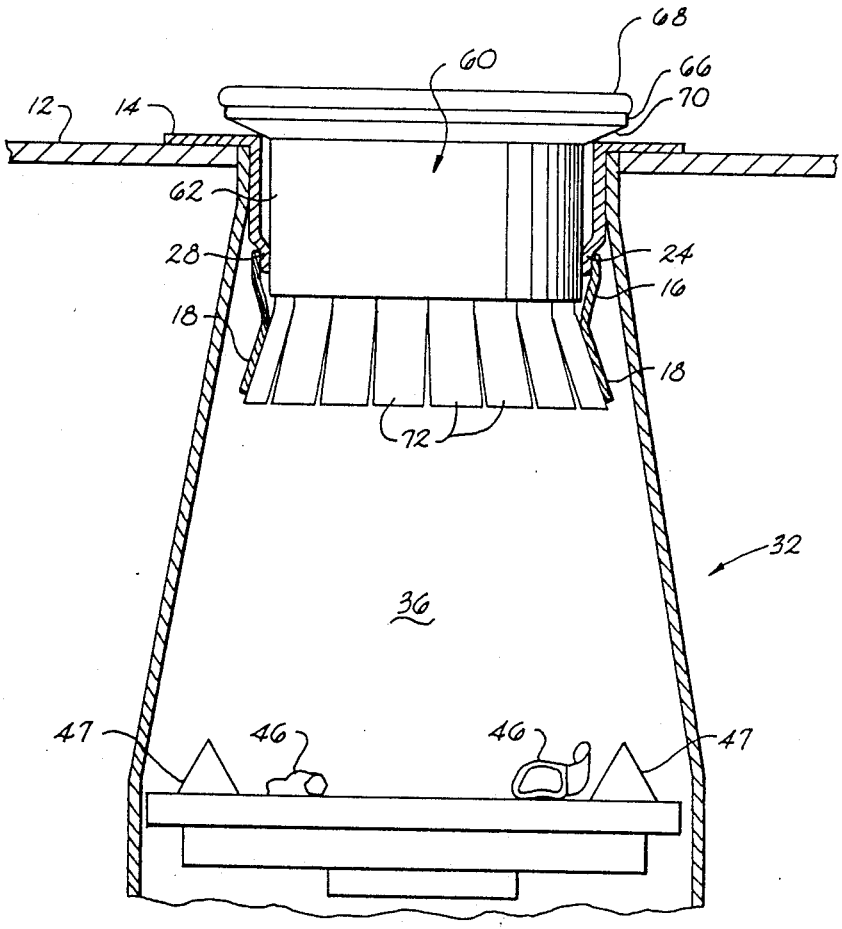
FIG. 6 illustrates a mixed side cross-sectional and partial view of the exemplary device of FIGS. 4 and 5 as received in a sink opening.

In the exemplary embodiment of FIGS. 4 through 6, a modified form of the device for aiding in removal of foreign matter from a garbage disposal unit 32 is illustrated. The device, generally indicated by the reference numeral 60, includes an outer supporting, cylindrical member 62 and an inner cylindrical member 64 slidably arranged in an axial direction and concentric with member 62. Both members 62 and 64 are preferably of thin wall construction, thereby enabling unobstructed access to the hopper 36, as will be described below.

Member 64 is axially longer than the member 62 and is provided at one end with an outwardly protruding rim 66 to which may be attached suitable padding material 68 for use by a user. The diameter of the rim is such that the same will engage one end of the outer member 62, also being formed with a thickened protruding, beveled rim 70, as a limit of relative movement between the members 62 and 64 in one position of operation of the device, as shown in FIG. 5. The rim 70 serves to limit the downward movement of the members 62 and 64 as a unit into the flange 14 of the sink.

At the other end of the inner member 64 remote from rim 66, the adjacent circular wall thereof is formed with respective blades 72 depending therefrom in an arrangement which preferably completely encircles that end. Preferably the inner member is made of plastic material which during manufacture is placed under stress so that the blades 72 become angled outwardly in their normal unflexed condition, as shown in FIG. 5. However, when associated with outer member 62, as shown in FIG. 4, blades 72 will be flexed inwardly against the resiliency which the blades provide. Other materials may also be utilized in the fabrication of inner member 64, such as spring steel, which would include outwardly angled blades 72 adapted to be flexed inwardly when drawn up into the outer member 62.

As shown in FIG. 4, with the blades 72 flexed inwardly against their radially outward resilient nature, the inner member 64 is held within the outer member by virtue of the frictional engagement of the blades against the inner surface wall of the member 62. The device 60, with the parts as shown in FIG. 4 in one position of operation, is thus ready for use within the disposal unit 32 if the need arises.

In operation, the device 60 as initially arranged in FIG. 4 is inserted into the sink flange 14 whereby the outer member 62 assumes the position shown in FIG. 6 with the rim 70 seated upon the flange 14. The user then manually pushes the inner member 64 downwardly utilizing the palm of his hand or some other implement held against the pad 68. The extent of the lowering of member 64 is terminated when rim 66 on member 64 engages rim 70 of member 62. In so moving in a relatively axial direction, blades 72 will be moved out of the confinement provided by the lower end of member 62 (i.e., unsheathed) to permit outward flexing of such blades as they become totally free of their confinement. These movements of the blades contact and spread radially outward the flexible members 18 of the splash guard 16 to their positions shown in FIG. 6. It can be readily seen that there is more access to the hopper 36 with such embodiment than that provided in the embodiment of FIGS. 2 and 3. Accordingly, additional light means may be omitted from the embodiment of FIGS. 4 through 6.

It should also be apparent that generally reverse steps can be taken in practice of this invention, i.e., resilient blades 72 can be resheathed in cylindrical member 62 by axially upward relative movement of member 64. Blades 72 become realigned during such process by their camming against the bottom edge or circumference of member 62.

While not expressly illustrated with the embodiment of FIGS. 4 through 6, grasping means 22 may be utilized for insertion into the hopper 36 through the inner member 64 for retrieving foreign matter 46. Since the resultant opening within the splash guard 16 rendered by the blades 72 is enlarged when compared to opening formed by the embodiment of FIGS. 2 and 3, sufficient light is available for viewing the interior of the hopper without the need of supplementation such as provided by the light source 40. However, it will be understood that a similar light source may be incorporated into the embodiment of FIGS. 4 through 6 in accordance with this invention.

As will be appreciated by those of ordinary skill in the art from the foregoing specification, various other embodiments of the present invention may be directed to environments and uses other than those illustrated in present FIGS. 2 and 3 and FIGS. 4 through 6. Moreover, it will be understood by those of ordinary skill in the art that the foregoing specification and drawings discussed with reference thereto are only exemplary embodiments of the present invention, with all such language being by way of example and illustration only, rather than language of limitation. Also, individual features and aspects of the foregoing exemplary embodiments may be varied for accommodating alternative practicing of the present invention, all without departing from the spirit and scope of the present invention set forth in the appended claims.

What is claimed is:

1. A device to aid in removal of foreign matter from a sink garbage disposal unit of the type having an interior refuse hopper and an elastomeric guard means adjacent an opening to such hopper, said device including an outer cylindrical member and an inner cylindrical member slidably retained and movable within said outer member for insertion into the hopper opening as a unit, with said inner member including means at one end thereof for providing access to the hopper by deflecting said elastomeric guard means so as to clear a pathway to such hopper, said inner member also defining an interior passageway therethrough which permits communication with such hopper, whereby improved access to and visibility of the hopper are provided so that foreign matter may readily be grasped and removed therefrom through said inner member passageway.

2. A device as in claim 1, wherein said means for deflecting said guard means includes resilient blades which are biased radially outward.

3. A device as in claim 1, wherein said inner member includes a rim disposed about the upper end thereof for limiting movement of said inner member relative to said outer member.

4. A device as in claim 1, wherein said outer member includes a beveled rim about the upper end thereof for limiting insertion of said device into a hopper.

5. A device as in claim 1, further including grasping means, for placement through said inner member and into the hopper, for grasping foreign matter for removal therefrom.

6. A device as in claim 5, wherein said grasping means includes two relatively long, slender pivotably attached bars comprising tongs, said bars including opposable teeth for securely grasping foreign matter within said disposal unit.

7. A device as in claim 1, further including light means mounted on said device for illuminating the hopper.

8. Apparatus for removal of foreign matter from a sink disposal unit of the type having a hopper disposed within said disposal unit for receiving waste material and a flexible splash guard disposed adjacent an opening to said hopper, said apparatus comprising:

a pair of concentrically arranged cylindrical members, having a central passageway defined within the inner member of said pair, for insertion into the hopper opening so as to provide access to the hopper through said central passageway, said inner member including a lower portion for extending beneath such hopper opening and being arranged to displace the flexible splash guard in a radially outward direction while so extending.

9. Apparatus as in claim 8, wherein said inner member has an upper rim having a diameter greater than that of said outer member for limiting relative movement therebetween.

10. Apparatus as in claim 9, wherein said rim is padded for manual manipulation by a user.

11. Apparatus as in claim 8, further including grasping means for insertion through said inner member central passageway for grasping and removing foreign matter from the hopper.

12. Apparatus as in claim 8, further including light means for illuminating the hopper.

13. Apparatus as in claim 8, wherein said inner member lower portion includes a plurality of resilient leaves, each of which are biased in a radially outward direction for displacement of the flexible splash guard.

14. Apparatus as in claim 8, wherein at least said inner member comprises a resilient material, such as one of resilient plastic and metal.

15. A device to aid in removal of foreign matter from a sink garbage disposal unit of the type having an interior refuse hopper and an elastomeric guard means adjacent an opening to such hopper, said device including a cylindrical unit arranged for insertion into the hopper opening, said unit including deflecting means at one end thereof which in one position of operation provides access to the hopper by deflecting said elastomeric guard means so as to clear a pathway to such hopper, and in another position of operation is inactive; and means for selectively operating said deflecting means into said positions thereof; said unit also defining an interior passageway therethrough which permits communication with such hopper whenever said elastomeric guard means are deflected, whereby improved access to and visibility of the hopper are provided so that foreign matter may readily be grasped and removed therefrom through said passageway.

16. A device as in claim 15, wherein said means for deflecting said guard means includes resilient blades biased in a radially outward direction.

17. A device as in claim 16, wherein said resilient blades are received on a lower end of an axially movable cylindrical member.

18. A device as in claim 15, wherein said means for selectively operating said deflecting means includes an outer cylindrical member into which said deflecting means is retained when in said inactive position thereof.

19. A device as in claim 15, further including light means for illuminating the interior refuse hopper.

20. A device as in claim 15, further including grasping means for withdrawing foreign matter from the interior refuse hopper through said device interior passageway.

* * * * *